US008474952B2

(12) United States Patent
Yoshida et al.

(10) Patent No.: US 8,474,952 B2
(45) Date of Patent: Jul. 2, 2013

(54) FLUID EJECTING APPARATUS AND FLUID EJECTING METHOD

(75) Inventors: Takeshi Yoshida, Shiojiri (JP); Masahiko Yoshida, Shiojiri (JP); Michiaki Tokunaga, Shiojiri (JP); Tatsuya Nakano, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 40 days.

(21) Appl. No.: 13/226,410

(22) Filed: Sep. 6, 2011

(65) Prior Publication Data

US 2012/0056924 A1 Mar. 8, 2012

(30) Foreign Application Priority Data

Sep. 7, 2010 (JP) ..... 2010-200178

(51) Int. Cl.
*B41J 29/38* (2006.01)

(52) U.S. Cl.
USPC ..... 347/41; 347/13

(58) Field of Classification Search
USPC ..... 347/13, 41
See application file for complete search history.

(56) References Cited

U.S. PATENT DOCUMENTS

| | | | |
|---|---|---|---|
| 5,844,585 | A | 12/1998 | Kurashima et al. |
| 6,439,677 | B1 | 8/2002 | Kanaya et al. |

FOREIGN PATENT DOCUMENTS

| | | | |
|---|---|---|---|
| JP | 09-011509 | A | 1/1997 |
| JP | 11-034398 | A | 2/1999 |
| JP | 2004-195991 | A | 7/2004 |
| JP | 2007-253348 | A | 10/2007 |

*Primary Examiner* — Julian Huffman
(74) *Attorney, Agent, or Firm* — Maschoff Brennan

(57) ABSTRACT

A fluid ejecting apparatus includes a nozzle row in which a plurality of nozzles that eject fluid onto a medium are arranged, a first movement unit that displaces a relative position between the medium and the nozzle row, and a control unit that forms a plurality of dot-lines by repeating a fluid ejection operation in which fluid is ejected so as to form a dot-line, such that a maximum time between when one of the adjacent dot-lines in the plurality of dot-lines is formed to when the other of the adjacent dot-lines is formed is reduced.

13 Claims, 10 Drawing Sheets

| PASS | 1 | 2 | 3 | 4 | 5 | 6 | 7 | 8 | |
|---|---|---|---|---|---|---|---|---|---|
| FEEDING DISTANCE | | 363 | 358 | 361 | 354 | 363 | 358 | 361 | /1440 |

PRINT RESOLUTION 1440 dpi

FLUID EJECTING APPARATUS AND FLUID EJECTING METHOD

BACKGROUND

1. Technical Field

The present invention relates to fluid ejecting apparatuses and fluid ejecting methods.

2. Related Art

Printing apparatuses have been developed that perform printing on a medium by repeating an ink ejection operation a plurality of times, in which a head is moved in a direction that intersects with a nozzle row (main scan direction) while ink is ejected onto the medium. In such a printing apparatus, the head is moved in a direction in which the nozzle row extends (sub-scan direction) during printing between each of the ink ejection operations. Such a printing apparatus performs an interlace printing in which the head is moved in the sub-scan direction at a constant pitch in order to reduce the occurrence of so-called banding, which may be caused by different properties of the respective nozzles. JP-A-11-34398 is an example of related art.

During movement of the head in the sub-scan direction, a paper sheet may sometimes expand and/or contract due to an effect of the ink that has landed on the paper sheet. If the ink ejection operation is performed in order to form dots on the paper sheet which has undergone such an expansion and/or contraction, the positions of lines which are formed by the dots may deviate from intended positions due to an effect of the expansion and/or contraction of the paper sheet. This degrades the quality of the resultant image. Therefore, it is desirable to reduce misalignment of the dot-lines.

SUMMARY

An advantage of some aspects of the invention is that misalignment of the dot-lines formed by the ejected fluid is reduced.

According to an aspect of the invention, a fluid ejecting apparatus includes a nozzle row in which a plurality of nozzles that eject fluid onto a medium are arranged, a first movement unit that displaces a relative position between the medium and the nozzle row in a cross direction that intersects with a direction in which the nozzle row extends, a second movement unit that displaces the relative position between the medium and the nozzle row in a nozzle row direction in which the nozzle row extends, and a control unit that forms a plurality of dot-lines by alternately repeating a fluid ejection operation in which the relative position in the cross direction is displaced while fluid is ejected so as to form a dot-line and a displacement operation in which the relative position in the nozzle row direction is displaced, the control unit controlling the fluid ejection operation and the displacement operation to be performed to form adjacent dot-lines in the plurality of dot-lines such that a maximum time between when one of the adjacent dot-lines is formed to when the other of the adjacent dot-lines is formed is smaller than that in the case where one of the adjacent dot-lines is formed by a first fluid ejection operation and then the other of the adjacent dot-lines is formed at a position between the dot-lines formed by the first fluid ejection operation in sequence from one end of the nozzle row.

The other characteristics of the invention will be apparent from the description herein taken in conjunction with the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
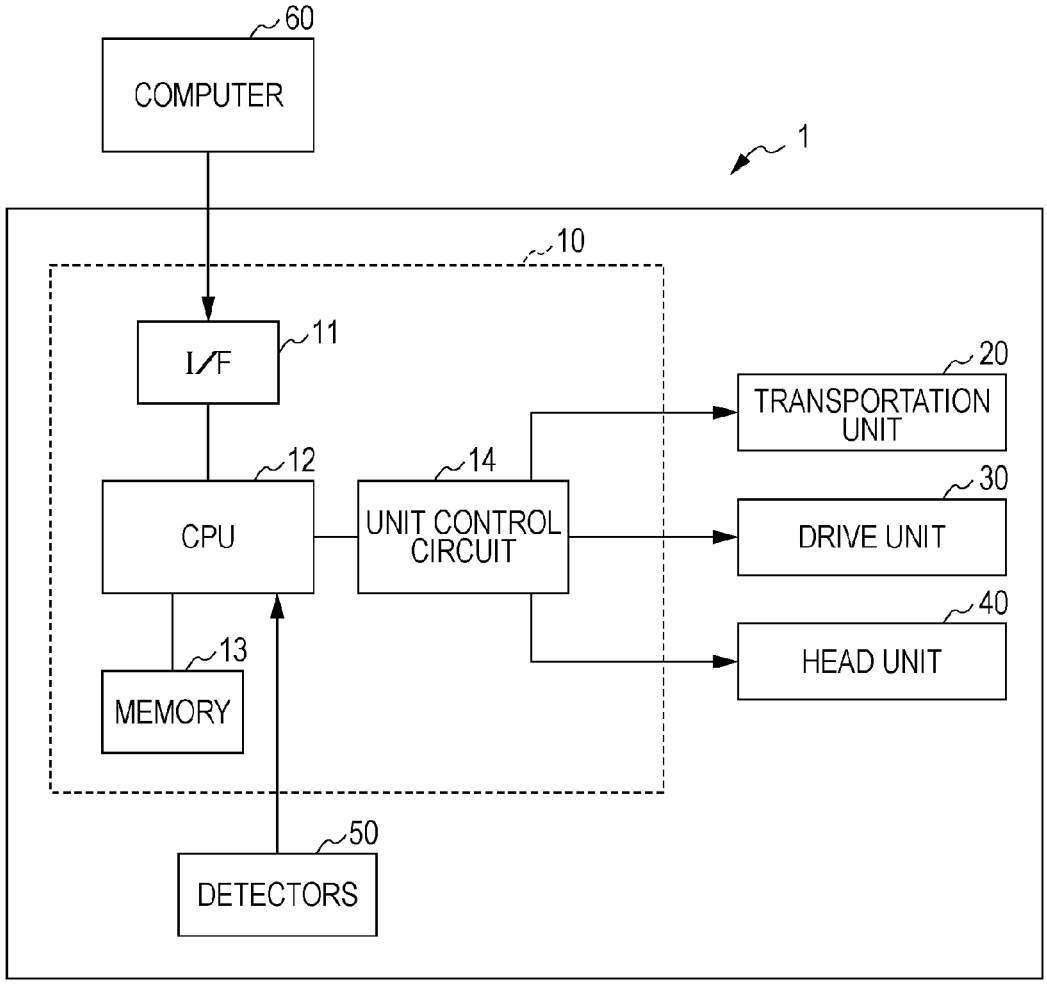
FIG. 1 is a configuration block diagram of a printing system.

The description herein and the accompanying drawings will describe at least the following:

a fluid ejecting apparatus including a nozzle row in which a plurality of nozzles that eject fluid onto a medium are arranged, a first movement unit that displaces a relative position between the medium and the nozzle row in a cross direction that intersects with a direction in which the nozzle row extends, a second movement unit that displaces the relative position between the medium and the nozzle row in a nozzle row direction in which the nozzle row extends, and a control unit that forms a plurality of dot-lines by alternately repeating a fluid ejection operation in which the relative position in the cross direction is displaced while fluid is ejected so as to form a dot-line and a displacement operation in which the relative position in the nozzle row direction is displaced, the control unit controlling the fluid ejection operation and the displacement operation to be performed to form adjacent dot-lines in the plurality of dot-lines such that a maximum time between when one of the adjacent dot-lines is formed to when the other of the adjacent dot-lines is formed is smaller than that in the case where one of the adjacent dot-lines is formed by a first fluid ejection operation and then the other of the adjacent dot-lines is formed at a position between the dot-lines formed by the first fluid ejection operation in sequence from one end of the nozzle row. With this configuration, misalignment of the dot-lines formed by the ejected fluid can be reduced.

In the fluid ejecting apparatus according to the above aspect, the control unit may be configured to control the fluid ejection operation and the displacement operation to be performed such that, after a certain dot-line is formed, the next two dot-lines are alternately formed on both sides of the previously formed dot-line, which is taken as a center dot-line. With this configuration, misalignment of positions of dots can be reduced while the dot-lines are formed in a regular manner.

In the fluid ejecting apparatus according to the above aspect, a displacement amount in the nozzle row direction is preferably larger than a nozzle pitch of the nozzles. With this configuration, the dot-lines can be formed in an order dispersed in the nozzle row direction. Accordingly, misalignment of positions of dots formed by the ejected fluid can be reduced.

Further, the fluid ejecting apparatus according to the above aspect preferably include a head unit having a plurality of the nozzle rows, and a length of the head unit in the nozzle row direction is preferably larger than a width of the medium in the nozzle row direction. Further, a distance between the nozzles on the head unit at both ends in the nozzle row direction is preferably larger than the width of the medium in the nozzle row direction. Accordingly, since the width of the head unit is longer than the width of the medium, fluid can be ejected onto a wide area on the medium with a single fluid ejection operation, so that misalignment of positions of dots medium can be reduced even in a circumstance that the medium is subject to expansion and/or contraction.

Further, the first movement unit preferably moves the nozzle row in the cross direction. With this configuration, the fluid ejection operation can be performed with the medium being fixed in position.

Further, the fluid ejecting apparatus according to the above aspect preferably include a third movement unit that transports the medium in the cross direction after all the dot-lines are formed on the medium. With this configuration, after fluid ejection is performed across the entire surface on a predetermined area of the medium, fluid can be performed on another area of the medium.

The description herein and the accompanying drawings will further describe:

A fluid ejecting method for use in a fluid ejecting apparatus including a nozzle row in which a plurality of nozzles that eject fluid onto a medium are arranged, a first movement unit that displaces a relative position between the medium and the nozzle row in a cross direction that intersects with a direction in which the nozzle row extends, and a second movement unit that displaces the relative position between the medium and the nozzle row in a nozzle row direction in which the nozzle row extends, wherein a plurality of dot-lines are formed by alternately repeating a fluid ejection operation in which the relative position in the cross direction is displaced while fluid is ejected so as to form a dot-line and a displacement operation in which the relative position in the nozzle row direction is displaced, the fluid ejecting method including performing the fluid ejection operation and the displacement operation so as to form adjacent dot-lines in the plurality of dot-lines such that a maximum time between when one of the adjacent dot-lines is formed to when the other of the adjacent dot-lines is formed is smaller than that in the case where one of the adjacent dot-lines is formed by a first fluid ejection operation and then the other of the adjacent dot-lines is formed at a position between the dot-lines formed by the first fluid ejection operation in sequence from one end of the nozzle row. With this configuration, misalignment of the dot-lines formed by the ejected fluid can be reduced.

First Embodiment

A printing system in which a printer and a computer are connected to each other will be explained as an example of the invention. In the following description, an ink jet printer (hereinafter referred to as "printer") is taken as an example of a fluid ejecting apparatus.

Figure 2A:
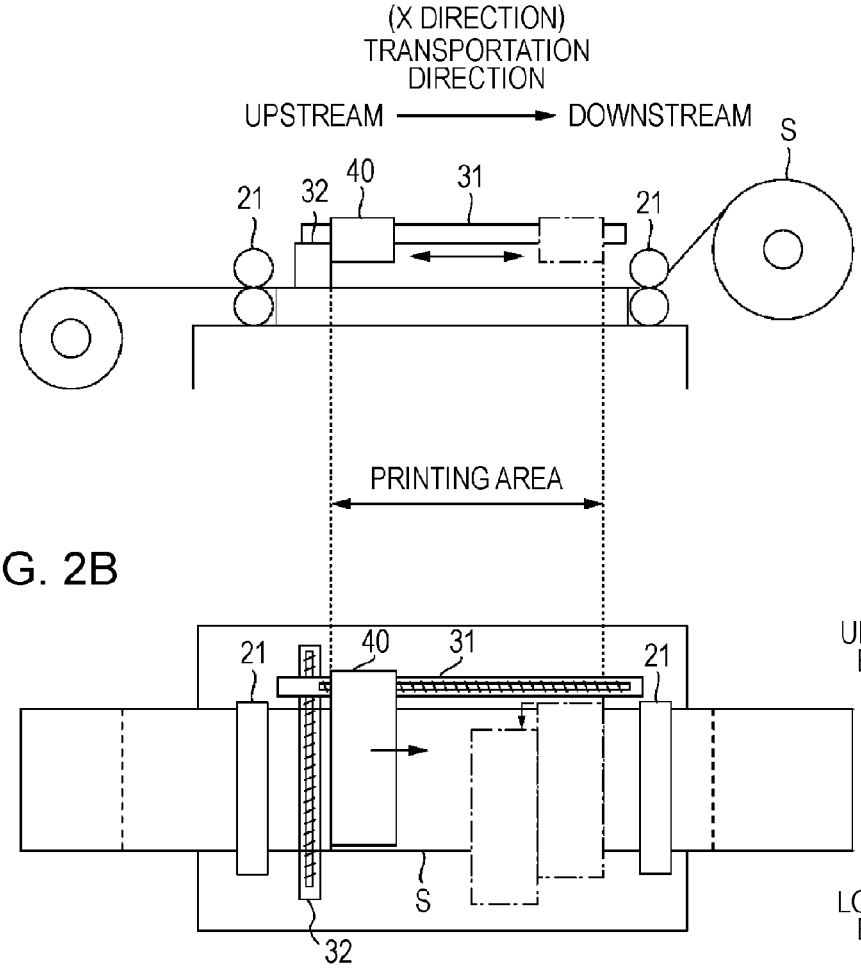
FIG. 2A is a schematic sectional view of a printer.
Figure 2B:
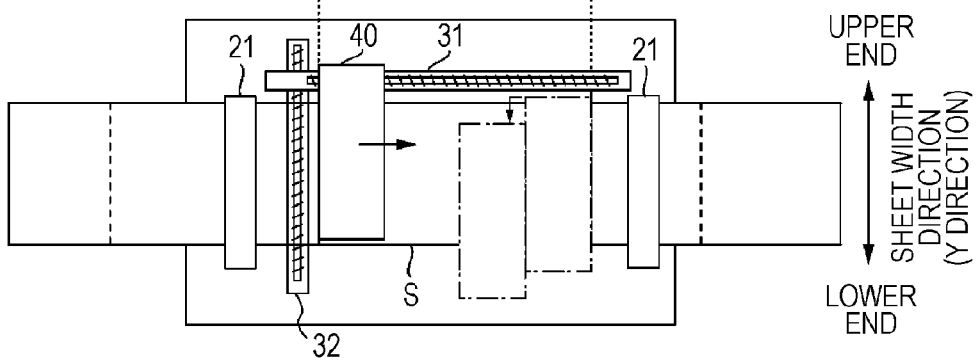
FIG. 2B is a schematic top view of the printer.

FIG. 1 is a configuration block diagram of the printing system. FIG. 2A is a schematic sectional view of a printer 1, and FIG. 2B is a schematic top view of the printer 1. A computer 60 is communicatively connected to the printer 1 and is configured to output print data to the printer 1 so that the printer 1 prints out the images. A program (printer driver) is installed in the computer 60, the program converting the image data which have been output from an application program into print data.

A controller 10 is a control unit that controls the printer 1. An interface 11 is provided for transmitting and/or receiving data between the computer 60 and the printer 1. A CPU 12 is a processing unit that controls the overall printer 1. A memory 13 is provided for ensuring a program storage area and a working area of the CPU 12. The CPU 12 controls each of the units through a unit control circuit 14. Further, a group of detectors 50 is provided for monitoring the situation in the printer 1 so that the controller 10 controls each of the units based on the detection results.

A transportation unit 20 is provided for sequentially transporting media S in an upstream to downstream direction (hereinafter, referred to as "transportation direction"). Transportation rollers 21 driven by a motor are provided so as to supply a medium S in a roll form prior to printing into a printing area. Then, a wind-up mechanism winds the printed medium S into a roll form. Moreover, when fed into the printing area, the medium S can be retained in a predetermined position by applying vacuum suction to the underside.

A drive unit 30 is configured to freely move a head unit 40 in an X direction which corresponds to the transportation direction of the medium S and in a Y direction which corresponds to a sheet width direction of the medium S. The drive unit 30 is composed of an X axis stage 31 on which the head unit 40 is moved in the X direction, a Y axis stage 32 on which the head unit 40 is moved in the Y direction, and a motor (not shown) which drives those stages.

The head unit 40 is provided for forming images and includes a plurality of heads 41. The underside of the head 41 is provided with a plurality of nozzles through which ink is ejected. The respective nozzles communicate with a pressure chamber which is filled with ink. The ejection of ink may be carried out using the piezoelectric technique in which a voltage is applied to piezoelectric elements (drive elements) so as to expand and/or contract the pressure chamber to expel ink through the nozzles, or alternatively, the thermal technique in which bubbles are generated within the nozzles by heat generating elements (drive elements) so that the bubbles expel ink through the nozzles.

Figure 3A:
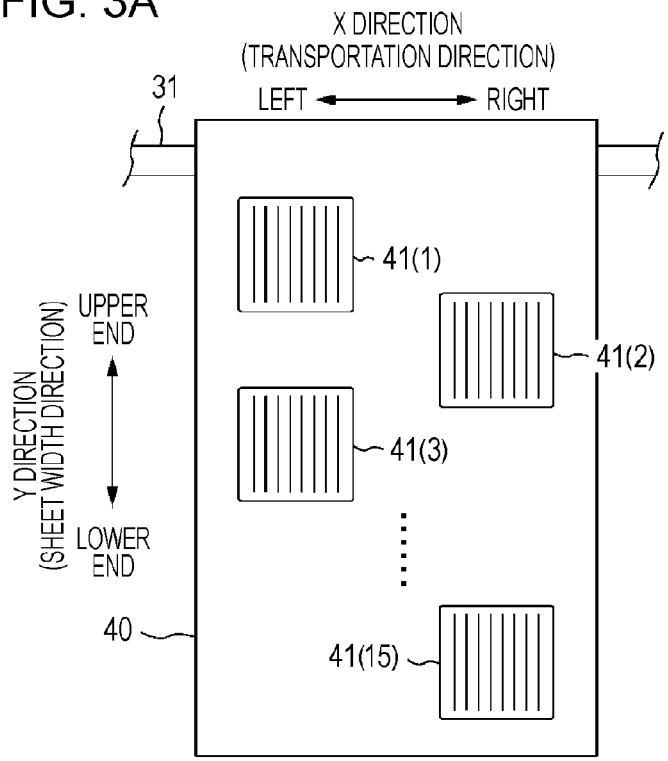
FIG. 3A is a view which shows an arrangement of a plurality of heads in a head unit.
Figure 3B:
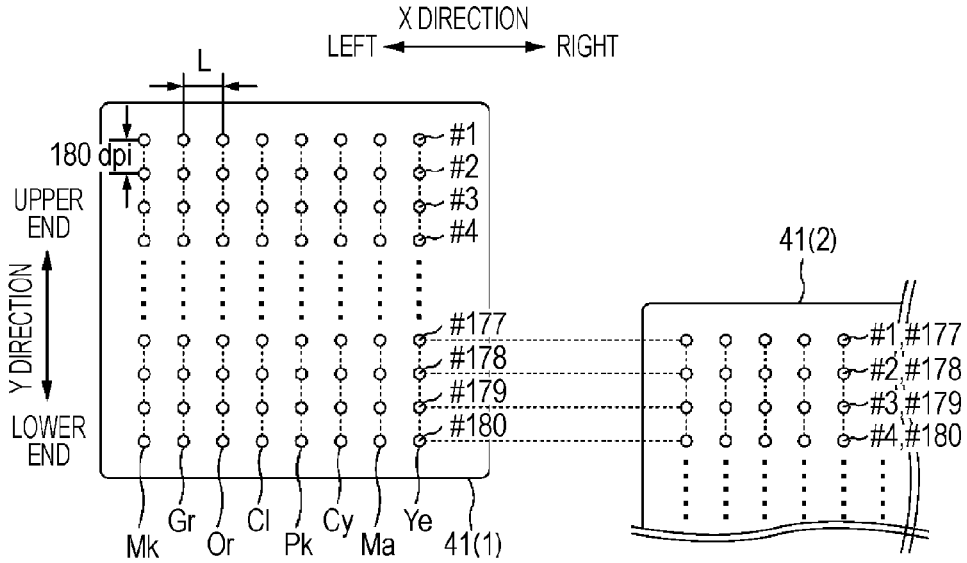
FIG. 3B is a view which shows an arrangement of nozzles in the head.

FIG. 3A is a view which shows an arrangement of a plurality of heads 41 in the head unit 40, and FIG. 3B is a view which shows an arrangement of nozzles in the head 41. The arrangement of the heads 41 and the nozzles is shown as seen from the head unit 40 in a virtual manner. In this case, the head unit 40 is shown as having 15 heads 41(1) to 41(15). In the head unit 40, 15 heads 41 are arranged in a staggered arrangement in the Y direction as shown in FIG. 3A due to manufacturing issues. That is, 15 heads 41 are disposed at different positions in the Y direction which are offset in the X direction. For clarity of explanation, the heads 41 are individually indicated as a first head 41(1), a second head 41(2), . . . and a fifteenth head 41(15), in sequence from the one located at the upper end in the Y direction.

Each head 41 has a nozzle surface on which eight nozzle rows are arranged as shown in FIG. 3B. Each nozzle row has 180 nozzles which are arranged at constant intervals (180 dpi) in the Y direction. For clarity, the nozzles are indicated by reference numbers in ascending order (#1 to #180) from the one located at the upper end in the Y direction. Further, the eight nozzle rows are arranged at constant intervals L in the X direction. The nozzle rows are arranged on the head 41 in the following order from the left in the X direction: a matte black nozzle row for ejecting matte black ink (hereinafter, referred to as "Mk"), a green nozzle row for ejecting green ink (hereinafter, referred to as "Gr"), an orange nozzle row for ejecting orange ink (hereinafter, referred to as "Or"), a clear nozzle row for ejecting clear ink (hereinafter, referred to as "Cl"), a photo black nozzle row for ejecting photo black ink (hereinafter, referred to as "Pk"), a cyan nozzle row for ejecting cyan ink (hereinafter, referred to as "Cy"), a magenta nozzle row for ejecting magenta ink (hereinafter, referred to as "Ma"), and a yellow nozzle row for ejecting yellow ink (hereinafter, referred to as "Ye").

Further, in two heads adjacent in the Y direction (for example, heads 41(1) and 41(2)), four nozzles from the lowest (nozzle #177, nozzle #178, nozzle #179 and nozzle #180) of the upper head (head 41(1)) and four nozzles from the highest (nozzle #1, nozzle #2, nozzle #3 and nozzle #4) of the lower head (head 41(2)) are aligned in the Y direction. Accordingly, the head 41(1) to the head 41(15) are arranged to establish the above relationship. With this arrangement, the head unit 40 can be regarded as a large single head which is capable of ejecting ink onto the area covered by the head 41(1) to head 41(15) when the head unit 40 is moved in the X direction. In this large integrated head unit 40, the nozzle #1 of the head 41(2) serves as the nozzle #177, the nozzle #2 serves as the nozzle #178, the nozzle #3 serves as the nozzle #179, and the nozzle #4 serves as the nozzle #180.

When nozzles are arranged in the above-mentioned manner in which two groups of nozzles overlap when viewed in the X direction, ink is ejected from one of the overlapping nozzle groups. For example, when ink is ejected from the nozzle #177 to the nozzle #180 of the head 41(1), ink is not ejected from the nozzle #1 to the nozzle #4 of the head 41(2). Similarly, when ink is ejected from the nozzle #1 to the nozzle #4 of the head 41(2), ink is not ejected from the nozzle #177 to the nozzle #180 of the head 41(1).

Further, the width of the head unit 40 in the sheet width direction is longer than the width of the paper sheet in the Y direction in the first embodiment. More specifically, the distance from the nozzle #1 of the head 41(1) to the nozzle #180 of the head 41(15) is longer than the width of the paper sheet in the Y direction. With this configuration, ink can be ejected so as to land on a wide area on the paper sheet with a single ink ejection operation (the ink ejection operation will be described later in detail).

Printing processes are as follows. First, the medium S is supplied to the printing area by the transportation unit 20. Then, the ink ejection operation (which corresponds to a fluid ejection operation), in which the head unit 40 is moved in the X direction (transportation direction of the medium) by using the X axis stage 31 while ink is ejected through the nozzles, and a transportation operation (which corresponds to a displacement operation), in which the head unit 40 is moved toward the lower end in the Y direction (sheet width direction) by using the Y axis stage 32 via the X axis stage 31, are alternately repeated. As a result, dots can be formed during each ink ejection operation with the positions of dots being offset from the previous positions, such that a 2D image can be printed. When printing on the medium S in the printing area is completed, the unprinted part of the medium S is fed to the printing area by means of the transportation unit 20 so that an image is printed on the part of the medium S which is newly fed to the printing area. A single ink ejection operation is hereinafter also referred to as a "pass".

Figure 4:
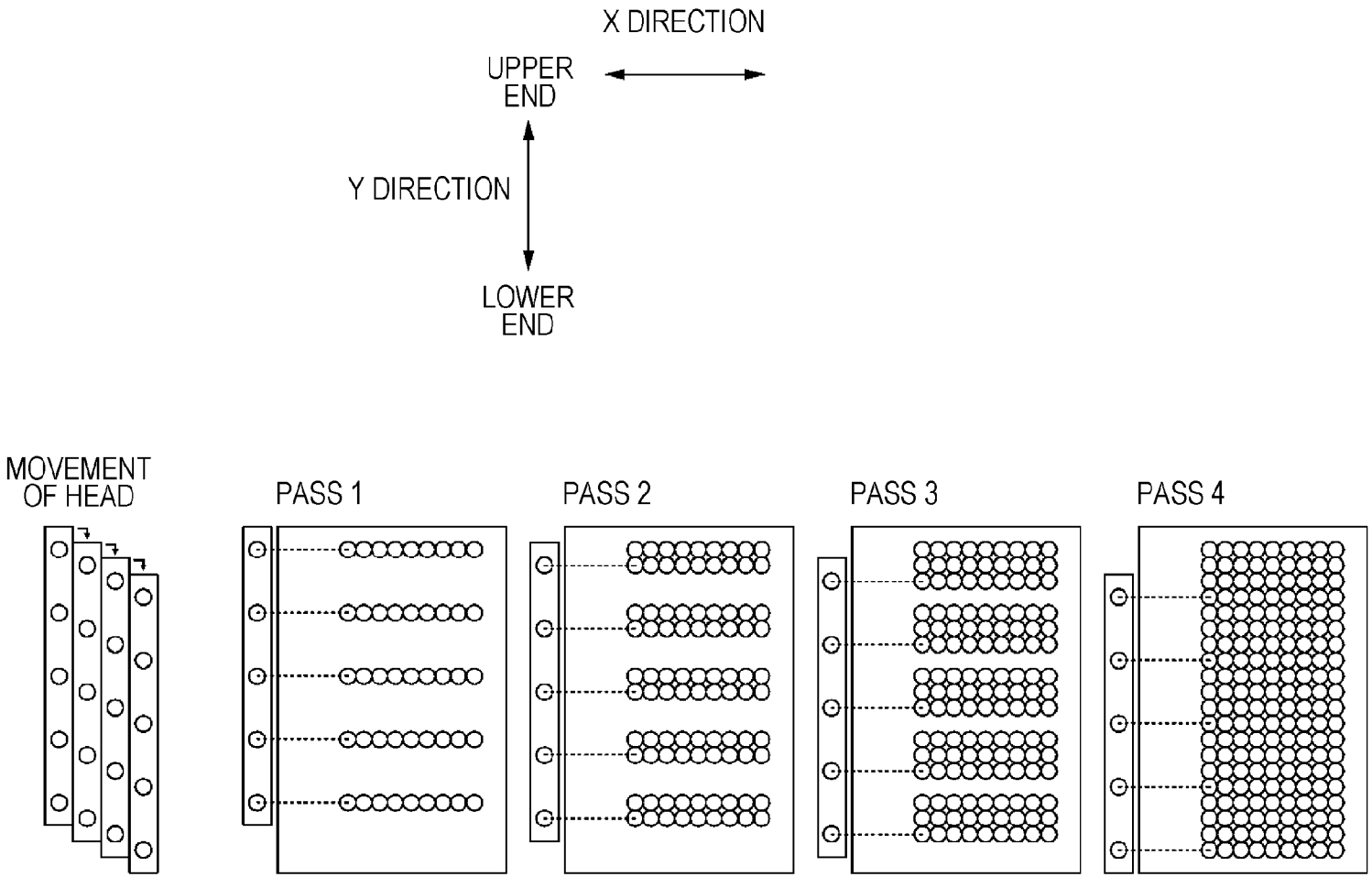
FIG. 4 is an explanatory view of dot-lines formed by the movement of the head in a reference example.

FIG. 4 is an explanatory view of dot-lines formed by the movement of the head in a reference example. To facilitate explanation, one nozzle row having five nozzles is shown in FIG. 4. The pitch between the nozzles is constant. FIG. 4 also shows the movement of the nozzle row. When each pass in which the head ejects ink while moving in the X direction is completed, the head moves in the Y direction. In the first embodiment, a print resolution is finer than the nozzle pitch. In this case, the head moves in the Y direction by a feeding distance which corresponds to the print resolution, with the feeding distance being set as 720 dpi (1/720 inch).

Consequently, when printing is performed under the condition that the paper sheet does not expand and/or contract during printing, the dot-lines formed during the pass 1 to pass 4 are appropriately disposed at intervals of 720 dpi in the Y direction.

Figure 5:
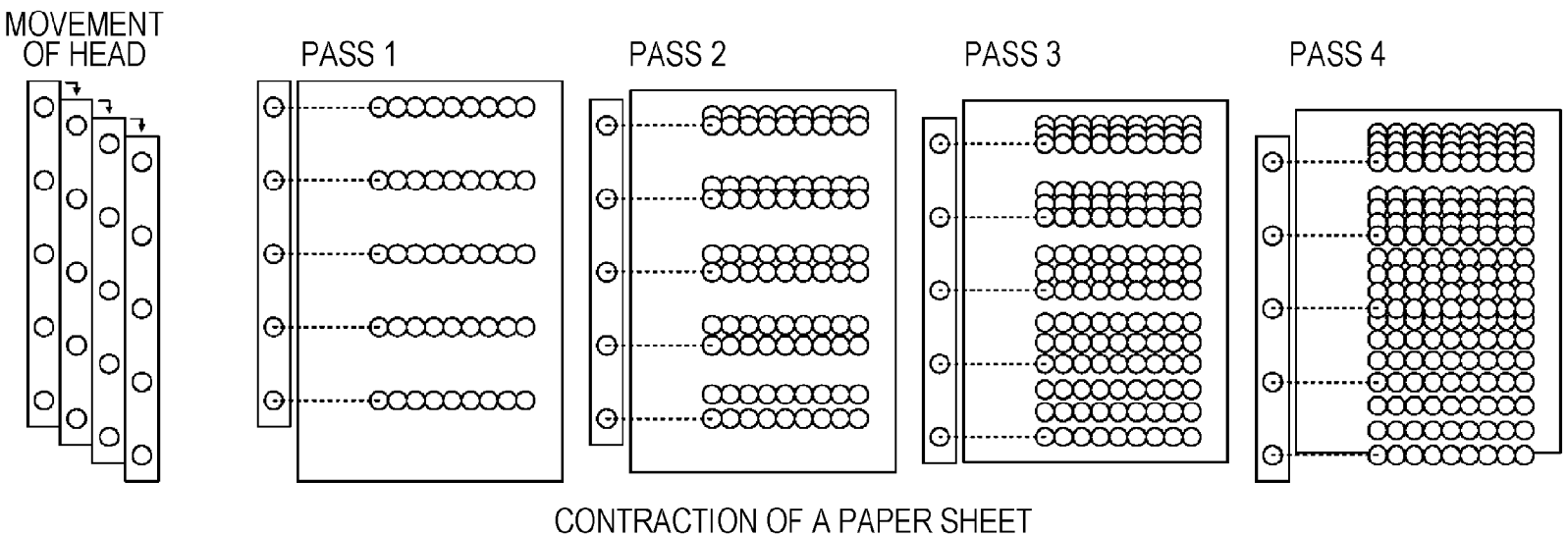
FIG. 5 is an explanatory view of dot-lines formed when a paper sheet contracts in a reference example.

FIG. 5 is an explanatory view of dot-lines formed when a paper sheet contracts in a reference example. Here, a nozzle row is shown as having the same configuration as that of FIG. 4. The nozzle row is also shown as having the same feeding distance as that of FIG. 4.

FIG. 5 differs from FIG. 4 in that the length of the paper sheet in the Y direction reduces as each pass is made. This may be caused by several reasons. For example, the paper sheet is heated during the process of drying ink after having landed on the paper sheet or the paper sheet contracts as time elapses due to the heat generated by the printing apparatus itself. Consequently, as shown in FIG. 5, when the paper sheet gradually contracts during printing, the dot-lines formed during the pass 1 to pass 4 are not appropriately disposed at intervals of 720 dpi in the Y direction.

Figure 6:
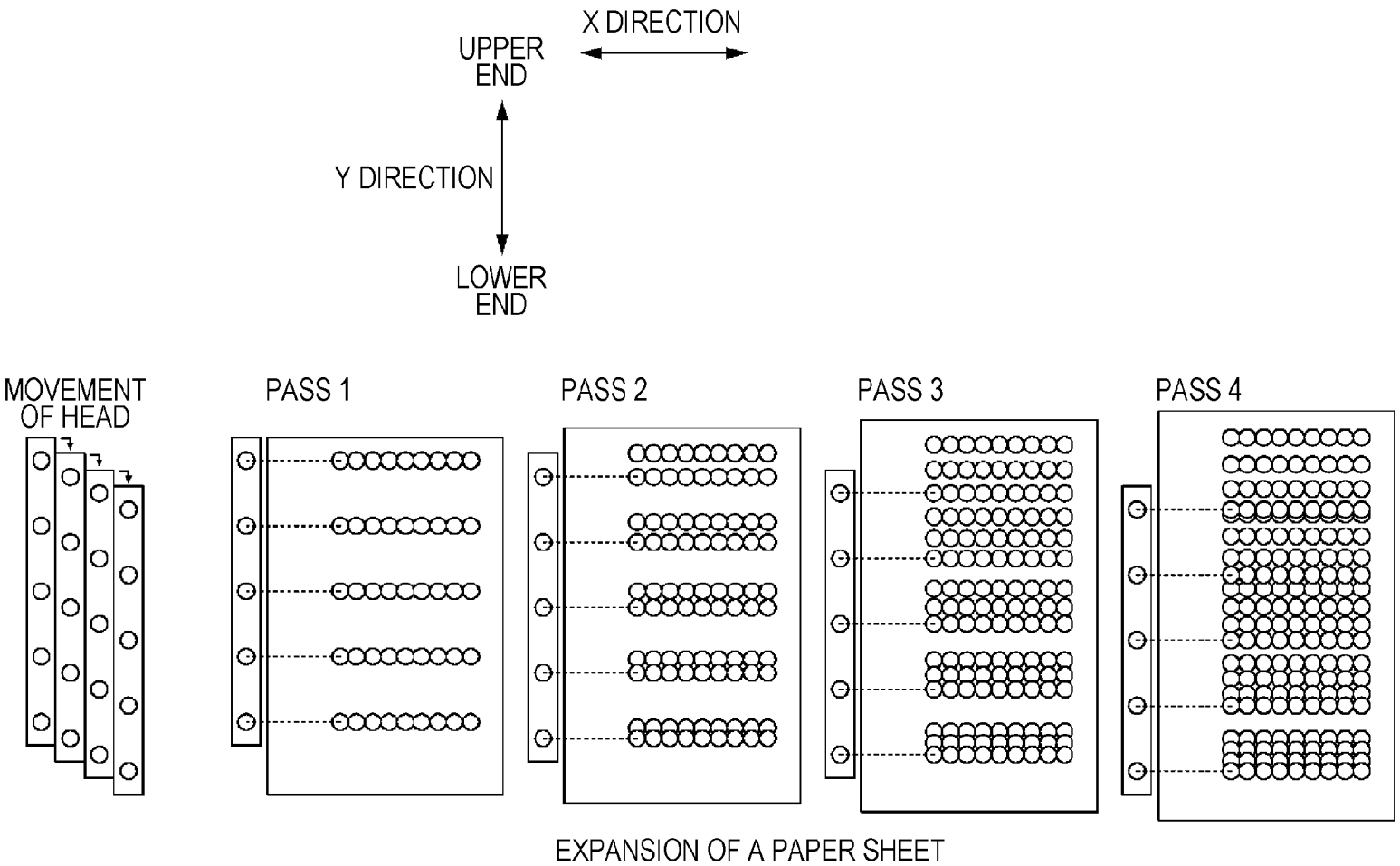
FIG. 6 is an explanatory view of dot-lines formed when a paper sheet expands in a reference example.

FIG. 6 is an explanatory view of dot-lines formed when a paper sheet expands in a reference example. Again, a nozzle row is shown as having the same configuration as that of FIG. 4. The nozzle row is also shown as having the same feeding distance as that of FIG. 4.

FIG. 6 differs from FIG. 4 in that the length of the paper sheet in the Y direction increases as each pass is made. This may be caused by several reasons, such as that the paper sheet expands due to an effect of water contained in the ink that has landed on the paper sheet. Specifically, in the printer according to the first embodiment having a configuration in which the width of the head unit 40 is larger than the sheet width of the paper sheet (the Y direction), ink lands on the paper sheet over a wide area during a single pass, resulting in the paper sheet expanding due to an effect of water contained in the ink. Consequently, as shown in FIG. 6, when the paper sheet gradually expands during printing, the dot-lines formed during the pass 1 to pass 4 are not appropriately disposed at intervals of 720 dpi in the Y direction.

A description of how to dispose dot-lines at appropriate intervals in the Y direction in the case where the paper sheet expands and/or contracts as mentioned above follows.

Figure 7:
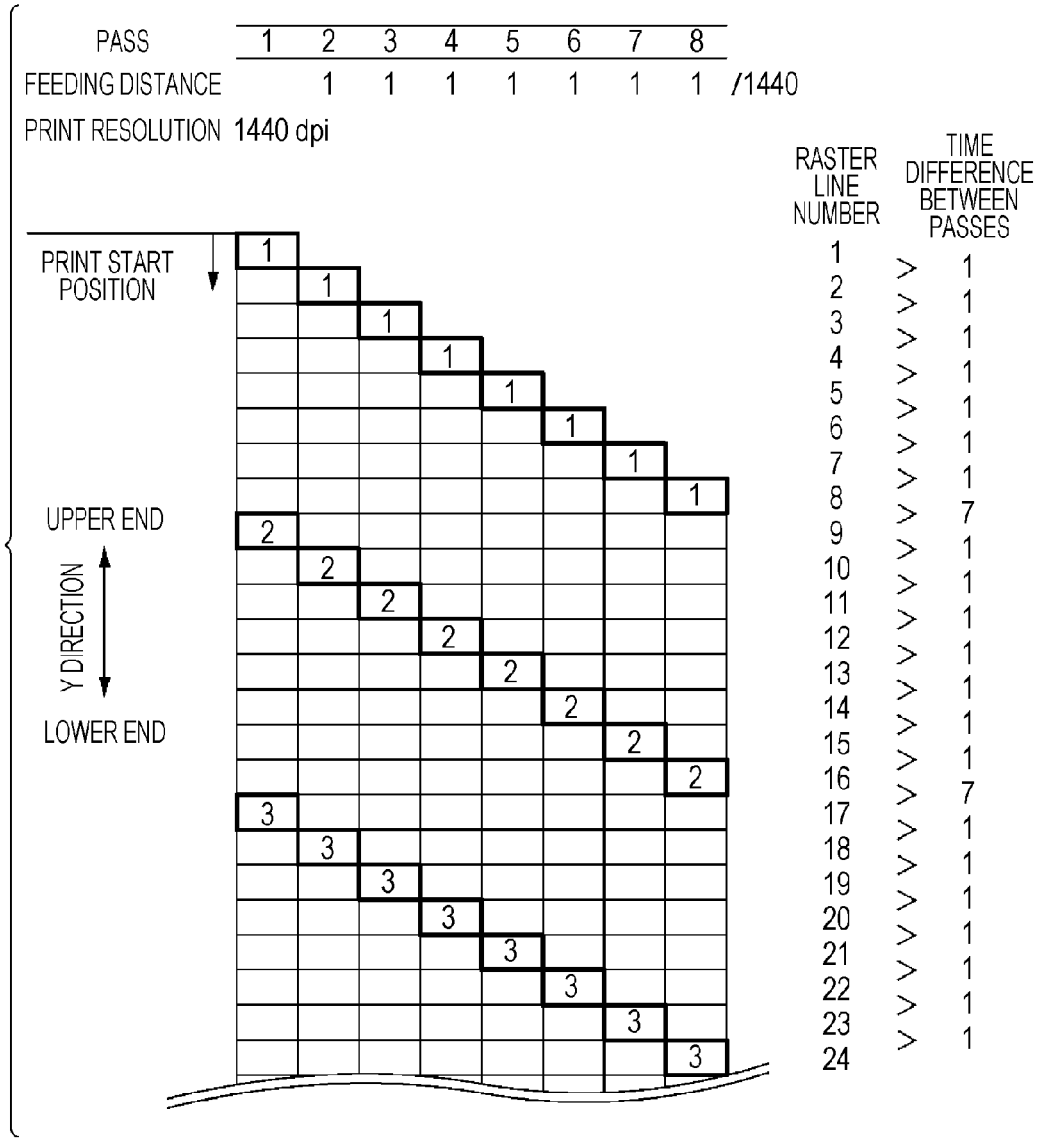
FIG. 7 is a view which shows a reference example of printing with a printing resolution of 1440 dpi.

FIG. 7 is a view which shows a reference example of printing with a printing resolution of 1440 dpi. FIG. 7 shows the feeding distance of the head in the Y direction from the pass 1 to pass 8 when the resolution is 1440 dpi. For example, when the feeding distance is "1", this means that the head moves in the Y direction by the amount of 1×1440 dpi. As a consequence, a dot-line is formed (or dots are formed) on each raster line. In the following description, "a dot-line is formed on the corresponding raster line" may be described as "a raster line is formed".

Each numeral enclosed in the rectangle corresponds to the nozzle number. To facilitate explanation, only the nozzle #1 to nozzle #3 are shown in FIG. 7. FIG. 7 also shows a print start position such that a first raster line to 24th raster line are formed in sequence from the upper position on the drawing.

In FIG. 7, when ink is ejected in the first pass (pass 1), for example, the nozzle #1 forms the first raster line, while the nozzle #2 forms the ninth raster line. Similarly, nozzles of other nozzle numbers form the corresponding raster lines.

Next, the head is moved in the Y direction by 720 dpi. Then, ink is ejected in the pass 2, for example, the nozzle #1 forms the second raster line, while the nozzle #2 forms the 10th raster line. Similarly, nozzles of other nozzle numbers form the corresponding raster lines. Accordingly, the respective raster lines are formed by repeating such operations.

During printing performed by the above-mentioned operations, the quality of the resultant image is affected by a time difference that exists between passes in which adjacent raster lines are formed. Here, the difference that exists between passes in which adjacent raster lines are formed is referred to as "time difference between the passes of adjacent raster lines" and defined as follows:

Absolute value (pass number of the pass in which the ith raster line is formed−pass number of the pass in which the (i+1)th raster line is formed)

For example, in the above reference example, the time difference between the passes of the first raster line and the second raster line is expressed by the absolute value (pass number of the pass in which the first raster line is formed−pass number of the pass in which the second raster line is formed), that is, the absolute value of (1−2), which results in the time difference between the passes being "1". Further, for example, the time difference between the passes of the eighth raster line and the ninth raster line is expressed by the absolute value (pass number of the pass in which the eighth raster line is formed−pass number of the pass in which the ninth raster line is formed), that is, the absolute value of (8−1), which results in the time difference between the passes being "7".

The larger the time difference between the passes of raster lines is, the larger the degree of expansion and/or contraction of the paper sheet that occurs between the successive passes. That is, positions of dots of the raster lines in the Y direction are less appropriately aligned. Specifically, when the time difference between the passes of raster lines significantly varies, the degree of expansion and/or contraction of the paper sheet that occurs between the successive passes also becomes large, resulting in the positions of dots in the Y direction being significantly misaligned. For example, in the case of FIG. 7, since the time difference between the passes of the eighth raster line and the ninth raster line is significantly different from that of raster lines, a band-like image may be formed between the eighth raster line and the ninth raster line.

As described above, when the time difference between the raster lines significantly varies, the quality of the resultant image decreases. Accordingly, it is desirable that the time difference between the passes varies to a lesser extent. That is, it is desirable that the head moves during printing so that a maximum time difference between the passes becomes smaller than a maximum time difference between the passes which is shown in FIG. 7 ("7" in this case) when the head unit 40 moves from the upper position in the Y direction at a rate of 1440 dpi.

Figure 8:
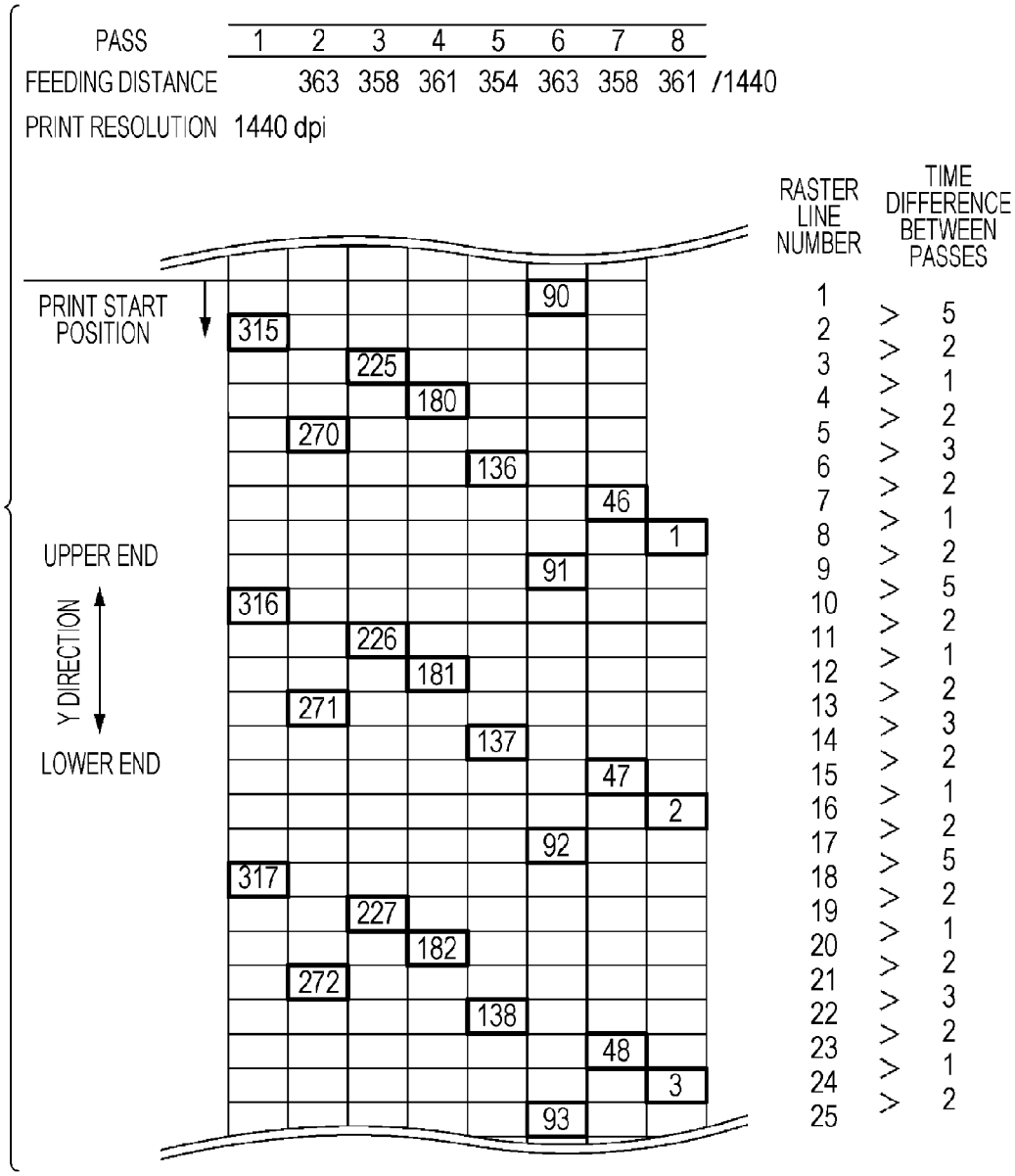
FIG. 8 is a view which explains the movement of the head (1440 dpi) according to a first embodiment.

FIG. 8 is a view which explains the movement of the head (1440 dpi) according to the first embodiment. The terms "pass", "feeding distance", "print resolution", "raster line number", and "time difference between the passes" shown in FIG. 8 are interpreted in the same manner as those of FIG. 7.

In FIG. 8, when ink is ejected in the first pass (pass 1), for example, the nozzle #315 forms the second raster line, while the nozzle #316 forms the 10th raster line. Accordingly, as far as shown in FIG. 8, the second raster line, the 10th raster line, and the 18th raster line are formed in the above-mentioned manner.

Next, the head is moved in the Y direction by 363×1440 dpi. Then, ink is ejected in the pass 2, for example, the nozzle #270 forms the fifth raster line, while the nozzle #271 forms the 13th raster line. Accordingly, as far as shown in FIG. 8, the fifth raster line, the 13th raster line, and the 21st raster line are formed in the above-mentioned manner.

The head unit 40 is moved in the Y direction by an amount which corresponds to the "feeding distance" during printing such that dots are formed in the subsequent passes. As a result, printing is performed in the printable area with a resolution of 1440 dpi.

In FIG. 8, it should be noted that a maximum value of the time difference between successive passes (hereinafter, referred to as "time difference between the passes") is small. Referring to the time difference between the passes shown in FIG. 8, a maximum time difference between the passes is "5". As mentioned above, when the time difference between the passes varies to a lesser extent, the quality of the resultant image increases. Therefore, the quality of printing can be improved by moving the head unit 40 during printing so that a maximum value of the time difference between the passes becomes smaller than that during printing which is shown in FIG. 7.

Second Embodiment

The following explains operations of the fluid ejecting apparatus according to a second embodiment. In the second embodiment, printing with a printing resolution of 720 dpi will be explained. Although the fluid ejecting apparatus of the second embodiment operates in a manner different from that of the first embodiment, the apparatus itself has the same configuration as that of the first embodiment, and the configuration of the fluid ejecting apparatus will not be explained further.

Figure 9:
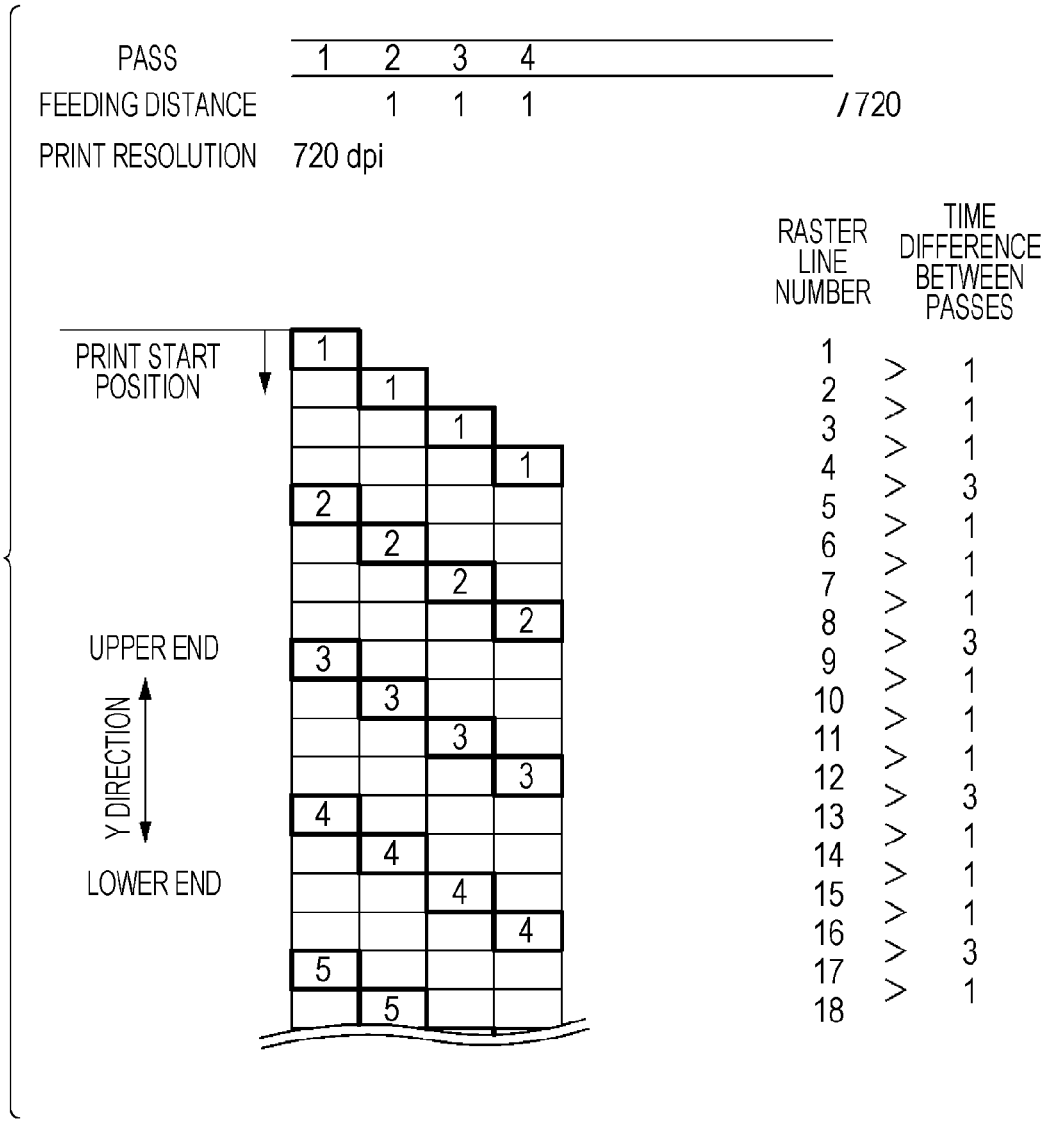
FIG. 9 is a view which shows a reference example of printing with a printing resolution of 720 dpi.

FIG. 9 is a view which shows a reference example of printing with a printing resolution of 720 dpi. FIG. 9 shows the feeding distance of the head unit 40 in the Y direction from the pass 1 to pass 4 when the resolution is 720 dpi. For example, when the feeding distance is "1", this means that the head unit 40 moves in the Y direction by the amount of 1×720 dpi.

FIG. 9 is interpreted in the same manner as in FIG. 7 and FIG. 8. In FIG. 9, a maximum value of the time difference between the passes is "3". The remaining values of the time difference between the passes are all "1". As mentioned above, the larger the time difference between the passes of raster lines is, the larger the degree of expansion and/or contraction of the paper sheet that occurs between the successive passes. Specifically, when the time difference between the passes of raster lines significantly varies, the degree of expansion and/or contraction of the paper sheet that occurs between the successive passes also becomes large, resulting in the positions of dots in the Y direction being significantly misaligned.

Figure 10:
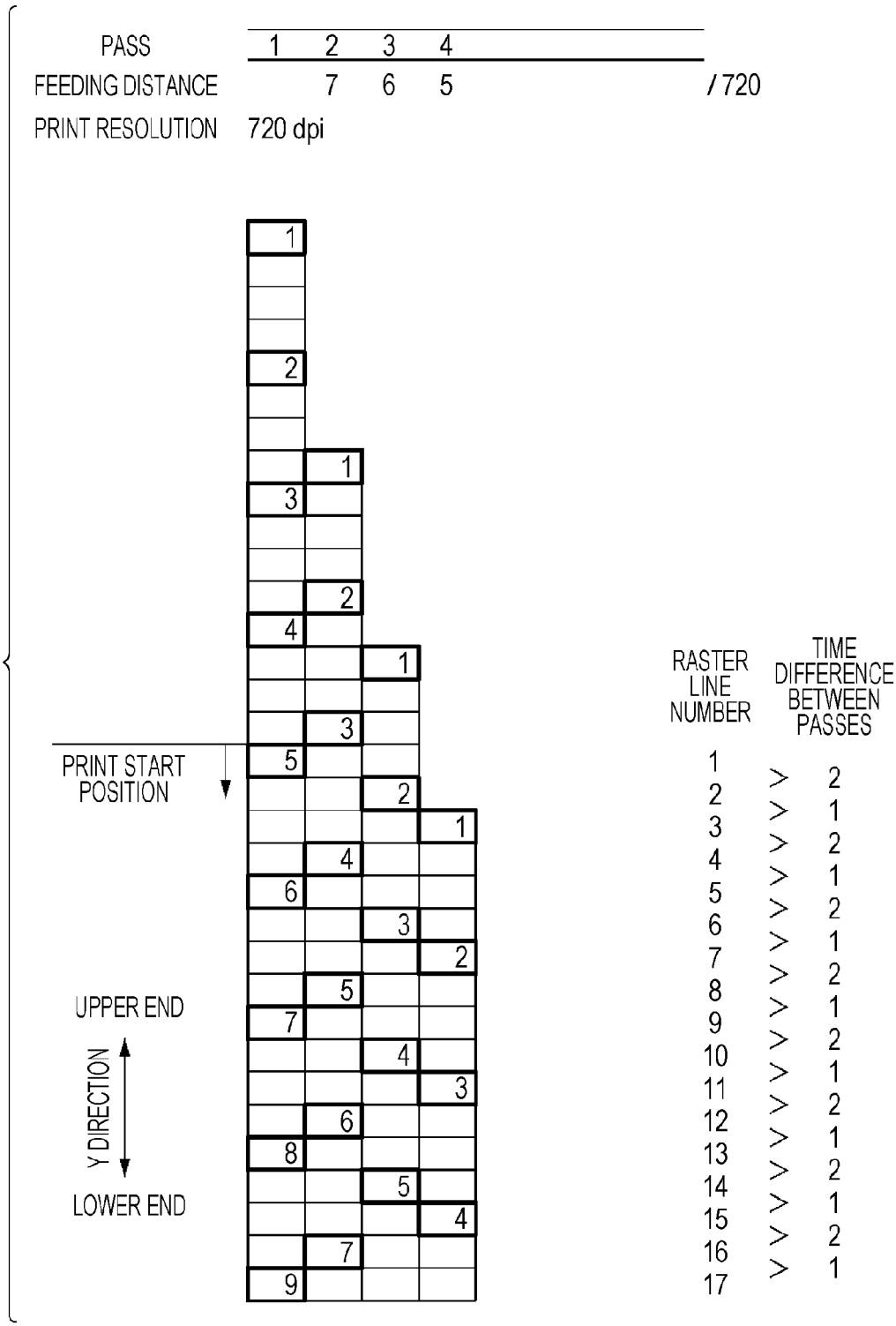
FIG. 10 is a view which explains the movement of the head (720 dpi) according to a second embodiment.

FIG. 10 is a view which explains the movement of the head (720 dpi) according to the second embodiment. The terms "pass", "feeding distance", "print resolution", "raster line number", and "time difference between the passes" shown in FIG. 10 are interpreted in the same manner as those of FIG. 9. According to FIG. 10, printing is performed in the printable area with a resolution of 720 dpi.

Also in FIG. 10, a maximum value of the time difference between the passes is smaller than that of the above reference example. Referring to the time difference between the passes shown in FIG. 10, a maximum time difference between the passes is "2". As mentioned above, when the time difference between the passes varies to a lesser extent, the quality of the resultant image increases.

Further, in FIG. 10, after a certain raster line (in this case, the second raster line) is formed, the next two raster lines (in this case, the first raster line and the third raster line) are alternately formed on both sides of the previously formed raster line, which is taken as the center raster line. With this configuration, misalignment of positions of dots can be reduced while the raster lines are formed in a regular manner.

Other Embodiment

In the foregoing embodiments, the printer 1 has been described as an example of fluid ejecting apparatus. However, the invention is not limited to the above description, and can be implemented as liquid ejecting apparatuses that eject or discharge fluid other than ink (e.g., liquid, liquid-like material in which particles of functional material are dispersed, and fluid-like material such as gel). For example, the similar technique to that described in the foregoing embodiments can be applied to various apparatuses in which ink jet technique is employed, such as color filter manufacturing apparatuses, dyeing machines, micro processing machines, semiconductor manufacturing apparatuses, surface processing machines, 3D forming machines, gas vaporizers, organic EL manufacturing apparatuses (especially, polymer EL manufacturing apparatuses), display manufacturing apparatuses, film deposition apparatuses, and DNA chip manufacturing apparatuses. Further, the methods and manufacturing methods used in the above apparatuses are intended to be within the scope of the invention.

The foregoing embodiments are described to facilitate understanding of the invention and are not intended to limit the interpretation of the invention. Various modifications and improvements can be made to the invention without departing from the spirit of the invention, and needless to say, the equivalents are included within the scope of the invention.

The entire disclosure of Japanese Patent Application No. 2010-200178, filed Sep. 7, 2010 is expressly incorporated by reference herein.

What is claimed is:

1. A fluid ejecting apparatus comprising:

a nozzle row in which a plurality of nozzles that eject fluid onto a medium are arranged, each nozzle row extending in a nozzle row direction;

a first movement unit that displaces a relative position between the medium and the nozzle row in a cross direction that intersects with the nozzle row direction;

a second movement unit that displaces the relative position between the medium and the nozzle row in the nozzle row direction; and a control unit that forms a plurality of dot-lines by repeating a fluid ejection operation in which the relative position in the cross direction is displaced while fluid is ejected so as to form a dot-line and a displacement operation in which the relative position in the nozzle row direction is displaced, the control unit controlling the fluid ejection operation and the displacement operation to form adjacent contiguous dot-lines in the plurality of dot-lines such that a timing difference between passes of nozzle row which forms the adjacent contiguous dot-lines is smaller than in the case where the plurality of contiguous dot-lines are formed by ejecting fluid from adjacent contiguous nozzles in sequential order from one end of the nozzle row to the other end of the nozzle row.

2. The fluid ejecting apparatus according to claim 1, wherein the control unit controls the fluid ejection operation and the displacement operation to be performed such that, after a certain dot-line is formed, the next two dot-lines are alternately formed on both sides of the previously formed dot-line, which is taken as a center dot-line.

3. The fluid ejecting apparatus according to claim 1, wherein a displacement amount in the nozzle row direction is larger than a nozzle pitch of the nozzles.

4. The fluid ejecting apparatus according to claim 1, further comprising a head unit having a plurality of the nozzle rows, wherein a length of the head unit in the nozzle row direction is larger than a width of the medium in the nozzle row direction.

5. The fluid ejecting apparatus according to claim 4, wherein a distance between the nozzles on the head unit at both ends in the nozzle row direction is larger than the width of the medium in the nozzle row direction.

6. The fluid ejecting apparatus according to claim 4, wherein the plurality of the nozzle rows of the head unit are arranged in a staggered arrangement.

7. The fluid ejecting apparatus according to claim 6, wherein the head unit has a plurality of heads that are arranged in a staggered arrangement, each of the plurality of heads has the plurality of the nozzle rows that are arranged in the cross direction, the plurality of the nozzle rows that are arranged in the cross direction are configured to each eject a different fluid.

8. The fluid ejecting apparatus according to claim 1, wherein the first movement unit moves the nozzle row in the cross direction.

9. The fluid ejecting apparatus according to claim 1, further comprising a third movement unit that transports the medium in the cross direction after all the dot-lines are formed on the medium.

10. The fluid ejecting apparatus according to claim 1, wherein a length of the medium in the nozzle row direction decreases due to an effect of the fluid ejection operation.

11. The fluid ejecting apparatus according to claim 1, wherein a length of the medium in the nozzle row direction increases due to an effect of the fluid ejection operation.

12. The fluid ejecting apparatus according to claim 1, wherein the control unit controls the fluid ejection operation and the displacement operation to be performed with a plurality of print resolutions, and wherein the timing difference is less than the amount of time required to perform seven passes using the second movement unit.

13. A fluid ejecting method for use in a fluid ejecting apparatus including:

a nozzle row in which a plurality of nozzles that eject fluid onto a medium are arranged, each nozzle row extending in a nozzle row direction;

a first movement unit that displaces a relative position between the medium and the nozzle row in a cross direction that intersects with the nozzle row direction; and a second movement unit that displaces the relative position between the medium and the nozzle row in the nozzle row direction, wherein a plurality of dot-lines are formed by alternately repeating a fluid ejection operation in which the relative position in the cross direction is displaced while fluid is ejected so as to form a dot-line and a displacement operation in which the relative position in the nozzle row direction is displaced, the fluid ejecting method comprising:

performing the fluid ejection operation and the displacement operation so as to form contiguous adjacent dot-lines in the plurality of dot-lines such that a maximum time between passes of nozzle row which forms the contiguous adjacent dot-lines is smaller than in the case where the plurality of contiguous dot-lines are formed by ejecting fluid from adjacent contiguous nozzles in sequential order from one end of the nozzle row to another.

* * * * *